US006760449B1

(12) United States Patent
Matsuo

(10) Patent No.: US 6,760,449 B1
(45) Date of Patent: Jul. 6, 2004

(54) MICROPHONE ARRAY SYSTEM

(75) Inventor: Naoshi Matsuo, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/415,504

(22) Filed: Oct. 12, 1999

(30) Foreign Application Priority Data

Oct. 28, 1998 (JP) ..... 10-306784

(51) Int. Cl.[7] ..... H04R 3/00
(52) U.S. Cl. ..... 381/92; 381/122
(58) Field of Search ..... 381/92, 122

(56) References Cited

U.S. PATENT DOCUMENTS 4,752,961 A * 6/1988 Kahn ..... 381/92
6,600,824 B1 * 7/2003 Matsuo ..... 381/92

FOREIGN PATENT DOCUMENTS

EP 0 795 851 A2 9/1997

OTHER PUBLICATIONS

Patent Abstracts of Japan, Tokkai–Hei08–006596, Mitsubishi Electric Corp. (Jun. 21, 1994).

* cited by examiner

*Primary Examiner*—F. W. Isen
*Assistant Examiner*—Elizabeth McChesney
(74) *Attorney, Agent, or Firm*—Armstrong, Kratz, Quintos, Hanson & Brooks, LLP

(57) ABSTRACT

A microphone array system includes a plurality of microphones and a sound signal processing part. The microphones are arranged in such a manner that at least three microphones are arranged in a first direction to form a microphone row, at least three rows of the microphones are arranged so that the microphone rows are not crossed each other so as to form a plane, and at least three layers of the planes are arranged three-dimensionally so that the planes are not crossed each other, so that the boundary conditions for the sound estimation at each plane of the planes constituting the three dimension can be obtained. The sound signal processing part estimates a sound in each direction of the three-dimensional space by estimating sound signals in at least three positions along a direction that crosses the first direction, utilizing the relationship between the gradient on the time axis of the sound pressure and the gradient on the spatial axis of the air particle velocity, and the relationship between the gradient on the spatial axis of the sound pressure and the gradient on the time axis of the air particle velocity, and based on a temporal variation of the sound pressure of the received sound signals of the arranged microphones in each spatial axis direction and a spatial variation of the received sound signals of the arranged microphones.

30 Claims, 14 Drawing Sheets

MICROPHONE ARRAY SYSTEM

BACKGROUND OF THE INVENTION

1. Field of the Invention

The present invention relates to a microphone array system, in particular, a microphone array system including three-dimensionally arranged microphones that estimates a sound to be received in an arbitrary position in a space by received sound signal processing and can estimate sounds in a large number of positions with a small number of microphones.

2. Description of the Related Art

Hereinafter, a sound estimation processing technique using a conventional microphone array system will be described.

A microphone array system includes a plurality of microphones arranged and performs signal processing by utilizing a sound signal received by each microphone. The object, configuration, use and effects of the microphone array system vary depending on how the microphones are arranged in a sound field, what kind of sounds the microphones receive, or what kind of signal processing is performed. In the case where a plurality of sound sources of a desired signal and noise are present in a sound field, high quality enhancement of the desired sound and noise suppression are important issues to be addressed for the processing of the sounds received by microphones. In addition, the detection of the position of the sound source is useful to various applications such as teleconference systems, guest-reception systems or the like. In order to realize processing for enhancing a desired signal, suppressing noise and detecting sound source positions, it is effective to use the microphone array system.

In the prior art, for the purpose of improving the quality of the enhancement of a desired signal, the suppression of noise, and the detection of a sound source position, signal processing has been performed with an increased number of microphones constituting the array so that more data of received sound signals can be acquired. FIG. 14 shows a conventional microphone array system used for desired signal enhancement processing by synchronous addition. The microphone array system shown in FIG. 14 includes real microphones $MIC_0$ to $MIC_{n-1}$, which are arranged in an array shown as 141, delay units $D_0$ to $D_{n-1}$ for adjusting the timing of signals of sounds received by the respective real microphones 141, and an adder 143 for adding signals of sounds received by the real microphones 141. In the enhancement of a desired sound according to this conventional technique, a sound from a specific direction is enhanced by adding plural received sound signals that are elements for addition processing. In other words, the number of sound signals used for synchronous addition signal processing is increased by increasing the number of the real microphones 141 so that the intensity of a desired signal is raised. In this manner, the desired signal is enhanced so that a distinct sound is picked out. As for noise suppression, synchronous subtraction is performed to suppress noise. As for the detection of the position of a sound source, synchronous addition or the calculation of cross-correlation coefficients is performed with respect to an assumed direction. In these cases as well, the quality of the sound signal processing is improved by increasing the number of microphones.

However, this technique for microphone array signal processing by increasing the number of microphones is disadvantageous in that a large number of microphones should be prepared to realize high quality sound signal processing, so that the microphone array system results in a large scale. Moreover, in some cases, it may be difficult to arrange microphones in number necessary for sound signal receiving of required quality in a necessary position physically because of spatial limitation.

In order to solve the above problems, it is desired to estimate a sound signal that would be received in an assumed position based on actual sound signals received by actually arranged microphones, rather than receiving a sound by microphones that are arranged actually. Furthermore, using the estimated signals, the enhancement of a desired signal, noise suppression and the detection of a sound source position can be performed.

The microphone array system is useful in that it can estimate a sound signal to be received in an arbitrary position on an array arrangement, using a small number of microphones. The microphone array system is preferable, in that it can estimate a sound signal to be received in an arbitrary position in a three-dimensional space, because sounds are propagated actually in the three-dimensional space. In other words, it is required not only to estimate a sound signal to be received in an assumed position on the extended line (one-dimensional) of a straight line on which a small number of microphones are aligned, but also to estimate with respect to a signal from a sound source that is not on the extended line while reducing estimation errors. Such high quality sound signal estimation is desired.

Furthermore, it is desired to develop an improved signal processing technique for signal processing procedures that are applied to the sound signal estimation so as to improve the quality of the enhancement of a desired sound, the noise suppression, the sound source position detection.

SUMMARY OF THE INVENTION

Therefore, with the foregoing in mind, it is an object of the present invention to provide a microphone array system with a small number of microphones arranged three-dimensionally that can estimate a sound signal to be received in an arbitrary position in the three-dimensional space with the small number of microphones.

Furthermore, it is another object of the present invention to provide a microphone array system that can perform sound signal estimation of high quality, for example by performing interpolation processing for predicting and interpolating a sound signal to be received in a position between a plurality of discretely arranged microphones, even if the number of microphones or the arrangement location cannot be ideal.

Furthermore, it is another object of the present invention to provide a microphone array system that realizes estimation processing that is better in sound signal estimation in an arbitrary position in the three-dimensional space than sound signal estimation processing used in the conventional microphone array system, and can perform sound signal estimation of high quality.

A microphone array system of the present invention includes a plurality of microphones and a sound signal processing part. As for the microphones, at least three microphones are arranged on each spatial axis. The sound signal processing part estimates a sound signal in an arbitrary position in a space by estimating a sound signal to be received at each axis component in the arbitrary position, utilizing the relationship between the difference, which is a gradient, between neighborhood points on the time axis of the sound pressure of a received sound signal of each microphone and the difference, which is a gradient, between neighborhood points on the spatial axis of the air particle velocity, and the relationship between the difference, which is a gradient, between neighborhood points on the spatial axis of the sound pressure and the difference, which is a gradient, between neighborhood points on the time axis of the air particle velocity, and based on the temporal variation of the sound pressure and the spatial variation of the air particle velocity of the received sound signal of each microphone arranged in each spatial axis direction; and synthesizing the estimated signals three-dimensionally.

This embodiment makes it possible to estimate a sound signal in an arbitrary position in a space by utilizing the relationship between the gradient on the time axis of the sound pressure calculated from the temporal variation of the sound pressure of a sound signal received by each microphone and the gradient on the spatial axis of the air particle velocity calculated based on a received signal between the microphones arranged on each axis.

Furthermore, a microphone array system of the present invention includes a plurality of microphones and a sound signal processing part. The microphones are arranged in such a manner that at least three microphones are arranged in a first direction to form a microphone row, at least three rows of the microphones are arranged so that the microphone rows are not crossed each other so as to form a plane, and at least three layers of the planes are arranged three-dimensionally so that the planes are not crossed each other, so that the boundary conditions for the sound estimation at each plane of the planes constituting the three dimension can be obtained. The sound signal processing part estimates a sound in each direction of a three-dimensional space by estimating sound signals in at least three positions along a direction that crosses the first direction, utilizing the relationship between the difference, which is a gradient, between neighborhood points on the time axis of the sound pressure of a received sound signal of each microphone and the difference, which is a gradient, between neighborhood points on the spatial axis of the air particle velocity, and the relationship between the difference, which is a gradient, between neighborhood points on the spatial axis of the sound pressure and a difference, which is a gradient, between neighborhood points on a time axis of the air particle velocity, and based on the temporal variation of the sound pressure and the spatial variation of the air particle velocity of received sound signals in at least three positions aligned along the first direction; and further estimating a sound signal in the direction that crosses the first direction based on the estimated signals in the three positions.

This embodiment provides the boundary conditions for the sound estimation at each plane of the planes constituting the three dimension, so that a sound signal in an arbitrary position in the three-dimensional space can be estimated by utilizing the relationship between the gradient on the time axis of the sound pressure calculated from the temporal variation of the sound pressure of a sound signal received by each microphone and the gradient on the spatial axis of the air particle velocity calculated based on a received signal between the microphones arranged on each axis.

Furthermore, a microphone array system of the present invention includes a plurality of directional microphones and a sound signal processing part. As for the directional microphones, at least two directional microphones are arranged with directivity on each spatial axis. The sound signal processing part estimates a sound signal in an arbitrary position in a space by estimating a sound signal to be received at each axis component in the arbitrary position utilizing the relationship between the difference, which is a gradient, between neighborhood points on the time axis of the sound pressure of a received sound signal of each microphone and the difference, which is a gradient, between neighborhood points on the spatial axis of the air particle velocity, and the relationship between the difference, which is a gradient, between neighborhood points on the spatial axis of the sound pressure and the difference, which is a gradient, between neighborhood points on the time axis of the air particle velocity, and based on the temporal variation of the sound pressure and the spatial variation of the air particle velocity of a received sound signal of each of the directional microphones arranged in each spatial axis direction; and synthesizing the estimated signals three-dimensionally.

This embodiment makes it possible to estimate a sound signal in an arbitrary position in a space by utilizing the gradient on the time axis of the sound pressure calculated from the temporal variation of the sound pressure of a sound signal received by each directional microphone, the gradient on the spatial axis of the air particle velocity calculated based on a received signal between the directional microphones arranged so that the directivities thereof are directed to the respective axes, and the correlation thereof.

Next, a microphone array system of the present invention includes a plurality of directional microphones and a sound signal processing part. The directional microphones are arranged in such a manner that at least two directional microphones are arranged with directivity to a first direction to form a microphone row, at least two rows of the directional microphones are arranged so that the microphone rows are not crossed each other so as to form a plane, and at least two layers of the planes are arranged three-dimensionally so that the planes are not crossed each other, so that the boundary conditions for the sound estimation at each plane of the planes constituting the three dimension can be obtained. The sound signal processing part estimates a sound in each direction of the three-dimensional space by estimating sound signals in at least two positions along a direction that crosses the first direction, utilizing the relationship between a difference, which is a gradient, between neighborhood points on the time axis of the sound pressure of a received sound signal of each microphone and the difference, which is a gradient, between neighborhood points on the spatial axis of the air particle velocity, and the relationship between the difference, which is a gradient, between neighborhood points on the spatial axis of the sound pressure and the difference, which is a gradient, between neighborhood points on the time axis of the air particle velocity, and based on the temporal variation of the sound pressure and the spatial variation of the air particle velocity of received sound signals in at least two positions aligned along the first direction; and further estimating a sound signal in the direction that crosses the first direction based on the estimated signals in the two positions.

This embodiment provides the boundary conditions for the sound estimation at each plane of the planes constituting the three dimension, and makes it possible to estimate a sound signal in an arbitrary position in the three-dimensional space by utilizing the gradient on the time axis of the sound pressure calculated from the temporal variation of the sound pressure of a sound signal received by each directional microphone, the gradient on the spatial axis of the air particle velocity calculated based on a received signal between the directional microphones arranged so that the directivities thereof are directed to respective axes, and the correlation thereof.

In the microphone array system, it is preferable that the relationship between the gradient on the time axis of the sound pressure and the gradient on the spatial axis of the air particle velocity of the received sound signal is expressed by Equation 2:

$$(v_x(x_{i+1},y_j,z_g,t_k)-v_x(x_i,y_j,z_g,t_k))+(v_y(x_i,y_{j+1},z_g,t_k)-v_y(x_i,y_j,z_g,t_k))+(v_z(x_i,y_j,z_{g+1},t_k)-v_z(x_i,y_j,z_g,t_k))=b(p(x_{i+1},y_{j+1},z_{g+1},t_{k+1})-p(x_{i+1},y_{j+1},z_{g+1},t_k)) \quad \text{Equation 2}$$

where x, y, and z are spatial axis components, t is a time component, v is the air particle velocity, p is the sound pressure, and b is a coefficient.

In the microphone array system, it is preferable that the sound signal processing part includes a parameter input part for receiving an input of a parameter that adjusts the signal processing content. One example of an input parameter is a sound signal enhancement direction parameter for designating a specific direction in which sound signal estimation is enhanced is supplied to the parameter input part, thereby enhancing a sound signal from a sound source in the specific direction. Another example of an input parameter is a sound signal attenuation direction parameter for designating a specific direction in which sound signal estimation is reduced is supplied to the parameter input part, thereby removing a sound signal from a sound source in the specific direction.

This embodiment makes it possible for a user to adjust and designate the signal processing content in the microphone array system.

In the microphone array system, it is preferable that the interval distance between adjacent microphones of the arranged microphones is within an interval distance that satisfies the sampling theorem on the spatial axis for the frequency of a sound signal to be received.

This embodiment makes it possible to perform high quality signal processing in a necessary frequency range by satisfying the sampling theorem.

In the microphone array system, it is preferable that the sound signal processing part includes a band processing part for performing band division processing and frequency shift for band synthesis for a received sound signal at the microphones.

This embodiment makes it possible to adjust the apparent bandwidth of a signal and shift the frequency of the signal received by the microphones, so that the same effect as that obtained by adjusting the sampling frequency of the signal received by the microphones can be obtained.

Furthermore, a microphone array system of the present invention includes a plurality of microphones and a sound signal processing part. As for the microphones, a plurality of microphones are arranged in three orthogonal axis directions in a predetermined space. The sound signal processing part connected to the microphones estimates a sound signal in an arbitrary position in a space other than the space where the microphones are arranged based on the relationship between the positions where the microphones are arranged and the received sound signals.

This embodiment makes it possible to estimate a sound signal in an arbitrary position in a space other than the space where the microphones are arranged.

In the microphone array system, it is preferable that the microphones are mutually coupled and supported on a predetermined spatial axis.

Preferably, this support member has a thickness of less than ½, preferably less than ¼, of the wavelength of the maximum frequency of the received sound signal, and preferably this support member is solid, and is hardly oscillated by the influence of the sound.

This embodiment makes it possible to provide a microphone array system where the microphones are arranged actually in a predetermined position interval distance, and the oscillation by the sound can be suppressed so as to reduce noise to the received signal.

These and other advantages of the present invention will become apparent to those skilled in the art upon reading and understanding the following detailed description with reference to the accompanying figures.

DESCRIPTION OF THE PREFERRED EMBODIMENTS

The microphone array system of the present invention will be described with reference to the accompanying drawings.

First, the basic principle of the sound signal estimation processing of the microphone array system of the present invention will be described below.

Sound is an oscillatory wave of air particles, which are a medium for sound. The following two wave equations shown in Equation 3 are satisfied between the changed value of the pressure in the air caused by the sound wave, that is, "sound pressure p", and the differential over time of the changed values (displacement) in the position of the air particles, that is, "air particle velocity v".

$$-\nabla v(x, y, z, t) = \frac{1}{K}\frac{\partial p(x, y, z, t)}{\partial t}$$
$$-\nabla p(x, y, z, t) = \rho\frac{\partial v(x, y, z, t)}{\partial t} \quad \text{Equation 3}$$

where t represents time, x, y, and z represent rectangular coordinate axes that define the three-dimensional space, K represents the volume elasticity (ratio of pressure and dilatation), and ρ represents the density (per unit volume) of the air medium. The sound pressure p is a scalar, and the particle velocity v is a vector. ∇ on the left side of Equation 3 represents a partial differential operation, and is represented by Equation 4, in the case of rectangular coordinates (x, y, z).

$$\nabla=(\partial/\partial x)x_I+(\partial/\partial y)y_I+(\partial/\partial z)z_I \quad \text{Equation 4}$$

where $x_I$, $y_I$ and $z_I$ represent vectors with a unit length in the directions of the x-axis, the y-axis and the z-axis, respectively. The right side of Equation 3 indicates a partial differential operation over time t.

The two wave equations shown in Equation 3 can be converted to difference equations, which are the forms used by actual calculation. Equation 3 can be converted to Equations (5) to (8).

$$p(x_{i+1},y_j,z_g,t_k)-p(x_i,y_j,z_g,t_k)=a(v_x(x_i,y_j,z_g,t_{k+1})-v_x(x_i,y_j,z_g,t_k)) \quad \text{Equation 5}$$

$$p(x_i,y_{j+1},z_g,t_k)-p(x_i,y_j,z_g,t_k)=a(v_y(x_i,y_j,z_g,t_{k+1})-v_y(x_i,y_j,z_g,t_k)) \quad \text{Equation 6}$$

$$p(x_i,y_j,z_{g+1},t_k)-p(x_i,y_j,z_g,t_k)=a(v_z(x_i,y_j,z_g,t_{k+1})-v_z(x_i,y_j,z_g,t_k)) \quad \text{Equation 7}$$

$$(v_x(x_{i+1},y_j,z_g,t_k)-v_x(x_i,y_j,z_g,t_k))+(v_y(x_i,y_{j+1},z_g,t_k)-v_y(x_i,y_j,z_g,t_k))+(v_z(x_i,y_j,z_{g+1},t_k)-v_z(x_i,y_j,z_g,t_k))=b(p(x_{i+1},y_{j+1},z_{g+1},t_{k+1})-p(x_{i+1},y_{j+1},z_{g+1},t_k)) \quad \text{Equation 8}$$

where a and b represent constant coefficients, $t_k$ is a sampling time, $x_i$, $y_j$ and $z_g$ represent positions for sound estimation on the x axis, y axis, and z axis, respectively, and are assumed to be spaced away with an equal interval distance herein. $v_x$, $v_y$, and $v_z$ represent an x axis component, a y axis component, and a z axis component of the particle velocity, respectively.

Figure 1:
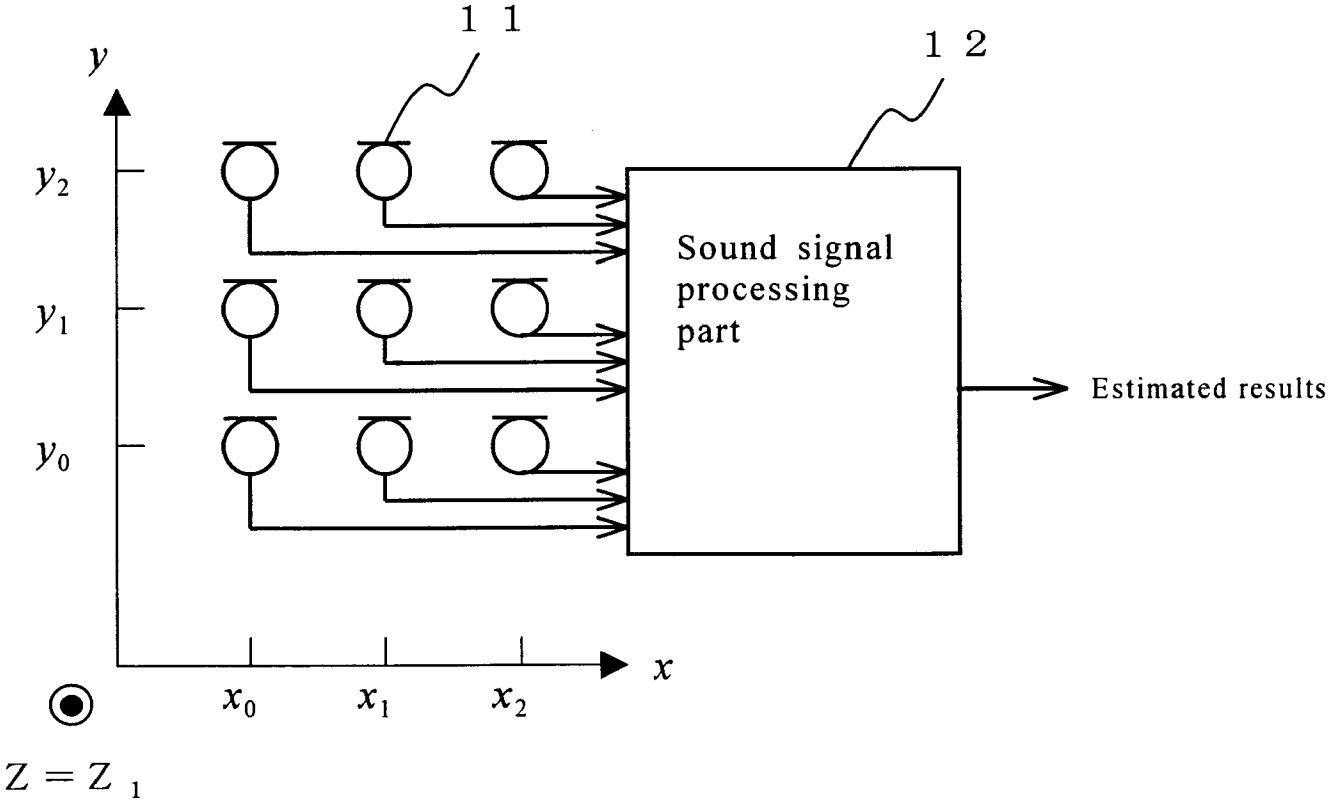
FIG. 1 is a schematic diagram of a basic configuration of a microphone array system of the present invention.

An example of the three-dimensional arrangement of microphones of the microphone array system of the present invention is as follows. Three microphones are arranged with an equal interval distance in each of the x, y, and z axis directions. This microphone array system includes 3×3×3=27 microphones arranged in total. The arrangement of the microphones can be indicated by the x coordinates ($x_0$, $x_1$, $x_2$), the y coordinates ($y_0$, $y_1$, $y_2$), and the z coordinates ($z_0$, $z_1$, $z_2$). FIG. 1 shows only the microphones that are on the xy plane and have a z value of $z_1$ of the microphone array system.

In this microphone array system in three-dimensional arrangement, it is assumed that the direction of a sound source is only one and known. For simplification, estimation is performed with respect to the received sound signals on the x axis. For the estimation of a received sound signal in the x axis direction in FIG. 1, a method for estimating the sound pressure and the air particle velocity in the x axis direction using Equations (5), (6) and (8) is described below. The estimation with respect to the y axis direction can be performed in the same manner.

In the microphone array system shown in FIG. 1, the particle velocity $v_z$ in the z axis direction cannot be obtained. Therefore, Equation 8 cannot be used as it is. Then, Equation 9 is led by eliminating the z axis components of the air particle velocity from Equation 8.

$$(v_x(x_{i+1},y_j,z_g,t_k)-v_x(x_i,y_j,z_g,t_k))+(v_y(x_i,y_{j+1},z_g,t_k)-v_y(x_i,y_j,z_g,t_k))=b'(p(x_{i+1},y_{j+1},z_{g+1},t_{k+1})-p(x_{i+1},y_{j+1},z_{g+1},t_k)) \quad \text{Equation 9}$$

where b' is a coefficient that depends on the direction θ of the sound source based on the xy plane, as shown in Equation 10.

$$b'=b\cos\theta \quad \text{Equation 10}$$

As the above, in the case where the sound source is single, and the direction of the sound source is known, Equation 9 can be used for sound signal estimation processing, and the coefficient b' can be changed depending on the direction θ of the sound source, as shown in Equation 10. However, in order to estimate signals from a plurality of sound sources in unknown directions, a method for estimation that does not depend on the direction θ of the sound source is required. The following is a method for estimation that does not depend on the direction θ of the sound source.

Generally, when it is assumed that the direction θ of the sound source is not changed significantly, because the sound source does not move in a large distance for a short time 1/Fs, Equation 11 below is satisfied, where Fs is a sampling frequency.

$$(v_x(x_i,y_j,z_g,t_k)-v_x(x_{i-1},y_j,z_g,t_k))+(v_y(x_{i-1},y_{j+1},z_g,t_k)-v_y(x_{i-1},y_j,z_g,t_k))=b'(p(x_i,y_{j+1},z_{g+1},t_{k+1})-p(x_i,y_{j+1},z_{g+1},t_k)) \quad \text{Equation 11}$$

When Equation 12 below is used herein, the right side of Equation 9 can be estimated from the right side of Equation 11.

$$p(x_{i+1}, y_{j+1}, z_{g+1}, t_{k+1}) - p(x_{i+1}, y_{j+1}, z_{g+1}, t_k) = \sum_{q=-1}^{1} c_q(p(x_i, y_{j+1}, z_{g+1}, t_{k+q+1}) - p(x_i, y_{j+1}, z_{g+1}, t_{k+q})) \quad \text{Equation 12}$$

The coefficient $c_q$ in Equation 12 is calculated with Equation 13 below.

$$\begin{bmatrix} c_{-1} \\ c_0 \\ c_1 \end{bmatrix} = \begin{bmatrix} p(x_i, y_{j+1}, z_{g+1}, t_k) - p(x_i, y_{j+1}, z_{g+1}, t_{k-1}) & p(x_i, y_{j+1}, z_{g+1}, t_{k+1}) - p(x_i, y_{j+1}, z_{g+1}, t_k) & p(x_i, y_{j+1}, z_{g+1}, t_{k+2}) - p(x_i, y_{j+1}, z_{g+1}, t_{k+1}) \\ p(x_i, y_{j+1}, z_{g+1}, t_{k-1}) - p(x_i, y_{j+1}, z_{g+1}, t_{k-2}) & p(x_i, y_{j+1}, z_{g+1}, t_k) - p(x_i, y_{j+1}, z_{g+1}, t_{k-1}) & p(x_i, y_{j+1}, z_{g+1}, t_{k+1}) - p(x_i, y_{j+1}, z_{g+1}, t_k) \\ p(x_i, y_{j+1}, z_{g+1}, t_{k-2}) - p(x_i, y_{j+1}, z_{g+1}, t_{k-3}) & p(x_i, y_{j+1}, z_{g+1}, t_{k-1}) - p(x_i, y_{j+1}, z_{g+1}, t_{k-2}) & p(x_i, y_{j+1}, z_{g+1}, t_k) - p(x_i, y_{j+1}, z_{g+1}, t_{k-1}) \end{bmatrix}^{-1} \begin{bmatrix} p(x_{i+1}, y_{j+1}, z_{g+1}, t_{k+1}) - p(x_i, y_{j+1}, z_{g+1}, t_k) \\ p(x_{i+1}, y_{j+1}, z_{g+1}, t_k) - p(x_{i+1}, y_{j+1}, z_{g+1}, t_{k-1}) \\ p(x_{i+1}, y_{j+1}, z_{g+1}, t_{k-1}) - p(x_{i+1}, y_{j+1}, z_{g+1}, t_{k-2}) \end{bmatrix} \quad \text{Equation 13}$$

Similarly, the left side of Equation 9 can be estimated from the left side of Equation 11 with the coefficient $c_q$, as shown in Equation 14 below.

$$(v_x(x_{i+1}, y_j, z_g, t_k) - v_x(x_i, y_j, z_g, t_k)) + (v_y(x_i, y_{j+1}, z_g, t_k) - v_y(x_i, y_j, z_g, t_k)) = \sum_{q=-1}^{1} c_q(v_x(x_i, y_j, z_g, t_{k+q}) - v_x(x_{i-1}, y_j, z_g, t_{k+q})) + (v_y(x_{i-1}, y_{j+1}, z_g, t_{k+q}) - v_y(x_{i-1}, y_j, z_g, t_{k+q})) \quad \text{Equation 14}$$

Next, an example of estimation of a received sound signal at an arbitrary point by processing with the above-described equations is shown below. Microphones are arranged actually as shown in FIG. 1, and a received sound signal at a point where no real microphone is arranged is estimated based on the received sound signals obtained from the sound source. ($x_3$, $y_0$, $z_1$) is selected as the point where no real microphone is arranged, and first the sound pressure p ($x_3$, $y_0$, $z_1$, $t_k$) at a time $t_k$ at the point is estimated.

Equations 5, 6, 13 and 14 are used to estimate the sound pressure p. Herein, it is assumed that $x_i - x_{i-1} = y_j - y_{j-1} =$ (sound velocity/sampling frequency). In this case, a=1 in Equation 4.

First, next air particle velocities, $v_x(x_0,y_0,z_1,t_k)$, $v_x(x_1,y_0,z_1,t_k)$, $v_y(x_0,y_0,z_1,t_k)$, $v_y(x_0,y_1,z_1,t_k)$, $v_y(x_1,y_0,z_1,t_k)$, and $v_y(x_1,y_1,z_1,t_k)$ are calculated from the sound signals received by the respective microphones.

Equations 15 and 16 are led from Equations 5 and 6.

$$v_x(x_i, y_j, z_g, t_{k+1}) = v_x(x_i, y_j, z_g, t_k) + \frac{1}{a}(p(x_{i+1}, y_j, z_g, t_k) - p(x_i, y_j, z_g, t_k)) \quad \text{Equation 15}$$

where i=0, 1, j=0, and g=1.

$$v_y(x_i, y_j, z_g, t_{k+1}) = v_y(x_i, y_j, z_g, t_k) + \frac{1}{a}(p(x_i, y_{j+1}, z_g, t_k) - p(x_i, y_j, z_g, t_k)) \quad \text{Equation 16}$$

where i=0, 1, j=0, 1, and g=1.

Secondly, the coefficients $c_{-1}$, $c_0$ and $c_1$ are calculated. Equation 17 is led from Equation 13.

$$\begin{bmatrix} c_{-1} \\ c_0 \\ c_1 \end{bmatrix} = \begin{bmatrix} p(x_1, y_1, z_1, t_k) - p(x_1, y_1, z_1, t_{k-1}) & p(x_1, y_1, z_1, t_{k+1}) - p(x_1, y_1, z_1, t_k) & p(x_1, y_1, z_1, t_{k+2}) - p(x_1, y_1, z_1, t_{k+1}) \\ p(x_1, y_1, z_1, t_{k-1}) - p(x_1, y_1, z_1, t_{k-2}) & p(x_1, y_1, z_1, t_k) - p(x_1, y_1, z_1, t_{k-1}) & p(x_1, y_1, z_1, t_{k+1}) - p(x_1, y_1, z_1, t_k) \\ p(x_1, y_1, z_1, t_{k-2}) - p(x_1, y_1, z_1, t_{k-3}) & p(x_1, y_1, z_1, t_{k-1}) - p(x_1, y_1, z_1, t_{k-2}) & p(x_1, y_1, z_1, t_k) - p(x_1, y_1, z_1, t_{k-1}) \end{bmatrix}^{-1} \begin{bmatrix} p(x_2, y_1, z_1, t_{k+1}) - p(x_2, y_1, z_1, t_k) \\ p(x_2, y_1, z_1, t_k) - p(x_2, y_1, z_1, t_{k-1}) \\ p(x_2, y_1, z_1, t_{k-1}) - p(x_2, y_1, z_1, t_{k-2}) \end{bmatrix} \quad \text{Equation 17}$$

Thirdly, the air particle velocity $v_x(x_2,y_0,z_1,t_k)$ in $x_2$ is calculated.

Equation 18 is led from Equation 14.

$$(v_x(x_2, y_0, z_1, t_k) = \left(v_x(x_1, y_0, z_1, t_k) - (v_y(x_1, y_1, z_1, t_k) - v_y(x_1, y_0, z_1, t_k)) + \sum_{q=-1}^{1} c_q(v_x(x_1, y_0, z_1, t_{k+q}) - v_x(x_0, y_0, z_1, t_{k+q})) + (v_y(x_0, y_1, z_1, t_{k+q}) - v_y(x_0, y_0, z_1, t_{k+q}))\right) \quad \text{Equation 18}$$

Fourthly and finally, the sound pressure $p(x_3, y_0, z_1, t_k)$ in $x_3$ is calculated.

Equation 19 is led from Equation 4.

$$p(x_3,y_0,z_1,t_k) = p(x_2,y_0,z_1,t_k) + a(v_x(x_2,y_0,z_1,t_k) - v_x(x_2,y_0,z_1,t_k)) \quad \text{Equation 19}$$

The sound pressure p and the air particle velocity v of an arbitrary point on the x axis can be estimated by repeating the first to fourth processes with respect to the x axis direction in the same manner as above.

Next, specific examples of the microphone array system employing the basic principle of the processing for estimating a sound signal to be received in an arbitrary position in the three-dimensional space are shown as Embodiments below. The arrangement of the microphones, the ingenuity as to the interval distance between the microphones, and the ingenuity as to sampling frequency will be also described.

Embodiment 1

Figure 2:
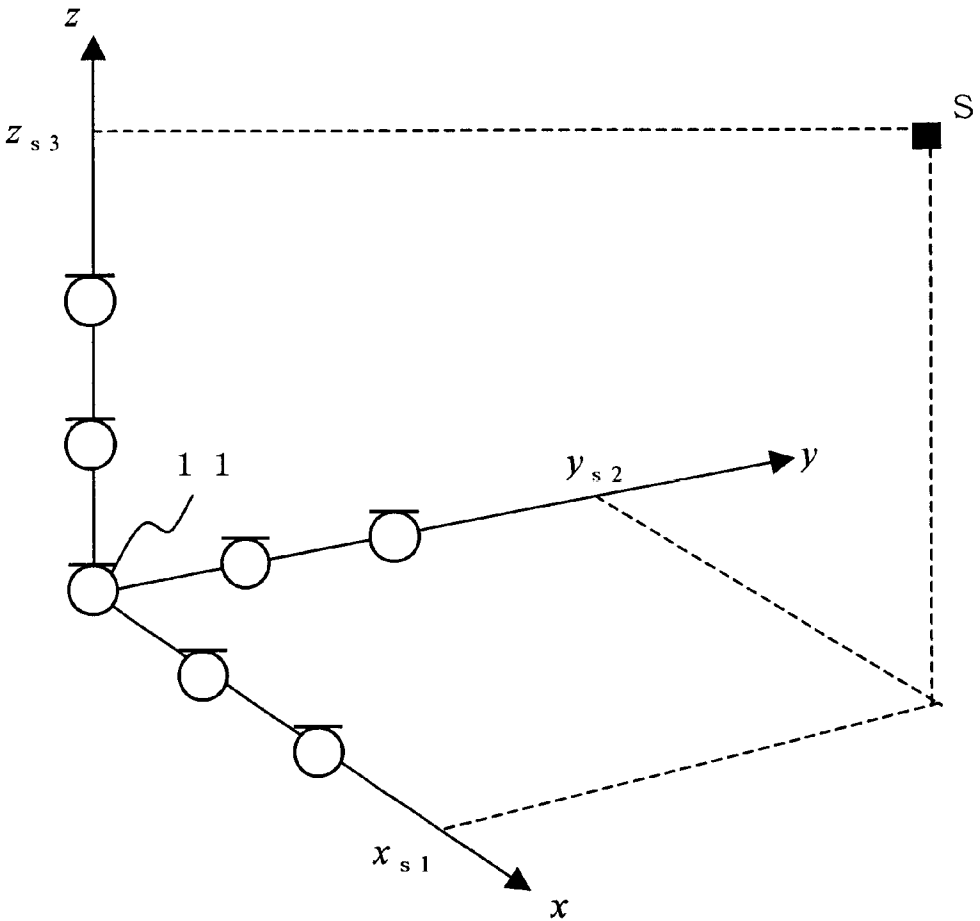
FIG. 2 is a schematic diagram of a basic configuration of a microphone array system of Embodiment 1 of the present invention.

FIG. 2 shows a microphone array system where three microphones are arranged on each axis, which is an illustrative arrangement where at least three microphones are arranged on each spatial axis.

In the microphone array system of this type, for estimation of a sound signal to be received in an arbitrary position S ($x_{s1}$, $y_{s2}$, $z_{s3}$), a sound signal to be received in each position corresponding to a component on each spatial axis in the arbitrary position S in a defined three-dimensional space is estimated, and a vector sum of the three-dimensional components is calculated.

As shown in FIG. 2, for estimation of a sound signal to be received in an assumed position S ($x_{s1}$, $y_{s2}$, $z_{s3}$) in the defined three-dimensional space, a sound signal to be received in a position corresponding to a component of each spatial axis of the assumed position S is estimated. In other words, first, a sound signal to be received in a position on each of ($x_{s1}$, 0, 0) on the x axis, (0, $y_{s2}$, 0) on the y axis and (0, 0, $z_{s3}$) on the z axis is estimated, applying the basic principle of the processing for estimating a sound signal to be received as described above. Next, the vector sum of the estimated sound signals to be received of the axis components is synthesized and calculated so that an estimated sound signal to be received in the assumed position S can be obtained.

In the embodiment where the components in the spatial axis directions are synthesized to obtain an estimated sound signal to be received, the processing for estimating a sound signal to be received can be performed easily, on the premise that an influence of the variation in the sound pressure and the air particle velocity of a sound signal in one spatial axis direction on the variation in the sound pressure and the air particle velocity of a sound signal in another spatial axis direction can be ignored.

As described above, in this embodiment, the basic principle for the estimation of a sound signal to be received is applied to the estimation in each spatial axis direction. The relationship between the difference, i.e., gradient between neighborhood points on the time axis of the sound pressure of a received sound signal of each microphone and the difference, i.e., gradient between neighborhood points on the spatial axis of the air particle velocity is utilized. In addition, the relationship between the difference, i.e., gradient between neighborhood points on the spatial axis of the sound pressure and the difference, i.e., gradient between neighborhood points on the time axis of the air particle velocity is utilized. Utilizing the above relationships and based on the temporal variation of the sound pressure and the spatial variation of the air particle velocity of the received sound signal of each microphone arranged in each spatial axis direction, a sound signal to be received in each axis component in an arbitrary position is estimated. Then, the estimated signals are synthesized three-dimensionally, so that a sound signal in the arbitrary position in the space can be estimated.

Embodiment 2

Figure 3:
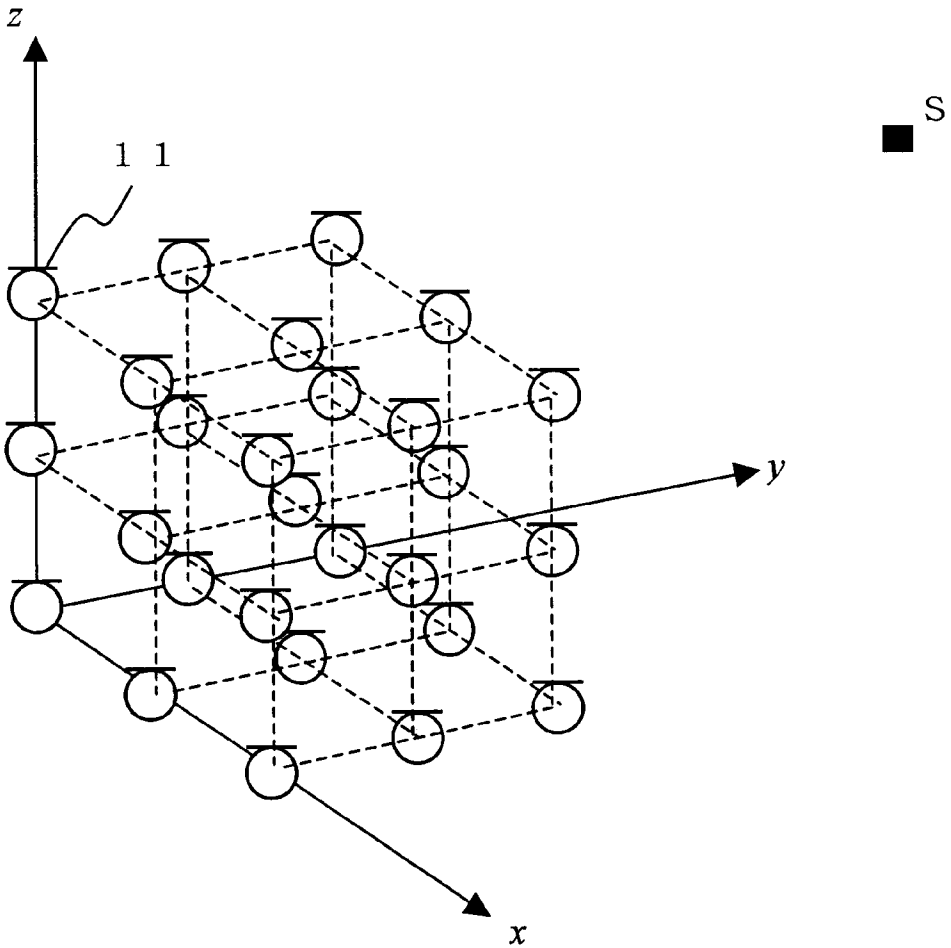
FIG. 3 is a schematic diagram of a basic configuration of a microphone array system of Embodiment 2 of the present invention.

As shown in FIG. 3, the microphone array system of Embodiment 2 is an example of the following arrangement. At least three microphones are arranged in one direction to form a microphone row. At least three rows of the microphones are arranged so that the microphone rows are not crossed each other so as to form a plane. At least three layers of the planes are arranged three-dimensionally so that the planes are not crossed each other. Thus, the microphones are arranged so that the boundary conditions for sound estimation at each plane of the planes constituting the three dimension can be obtained. The microphone array system of Embodiment 2 includes 27 microphones, which is the smallest configuration of this arrangement.

Figure 4:
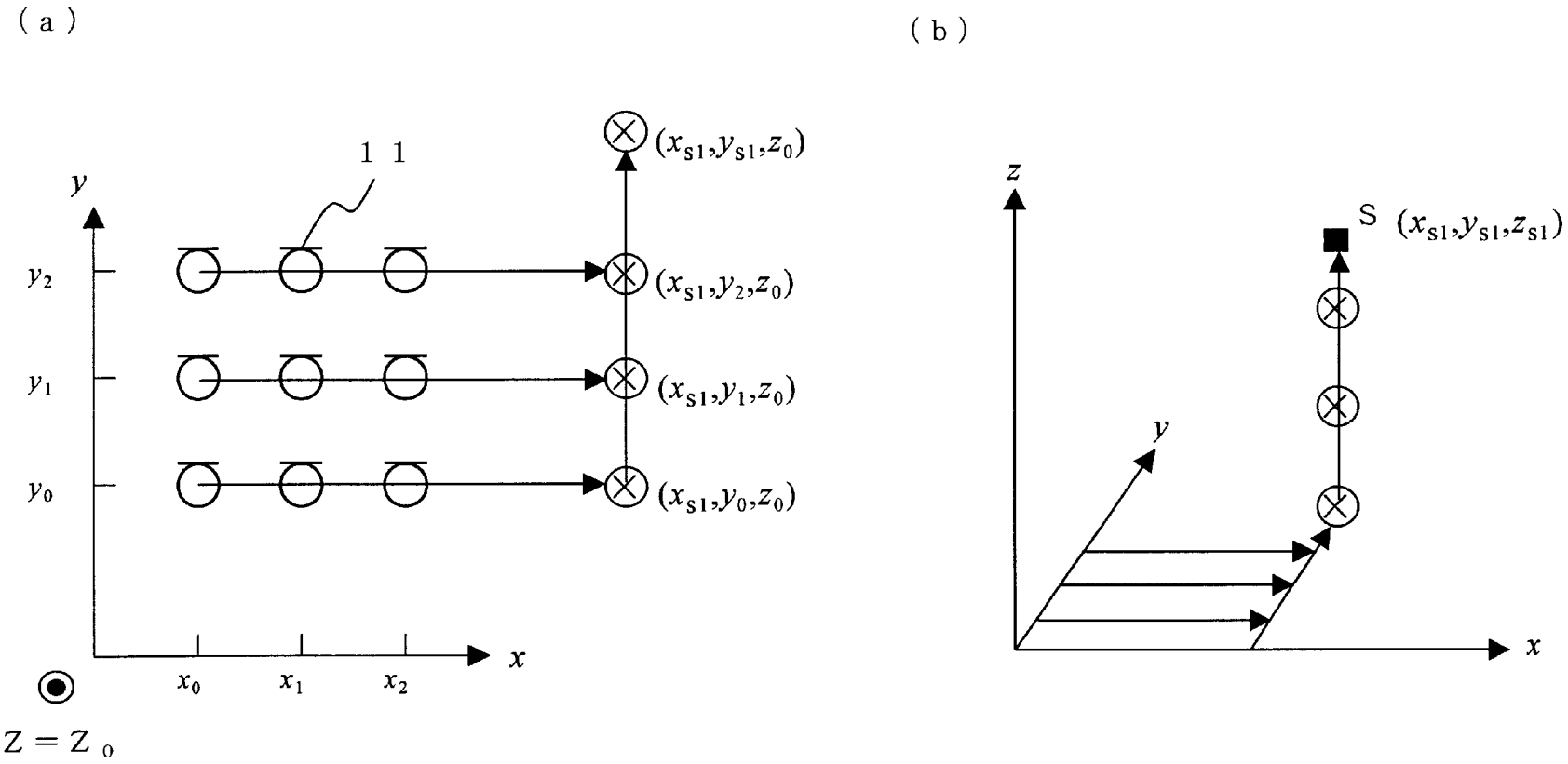
FIGS. 4(*a*) and 4(*b*) are schematic diagrams showing the estimation of a sound signal to be received in a position S ($x_{s1}$, $y_{s2}$, $z_{s3}$), utilizing the microphone array system of Embodiment 2 of the present invention.

In the microphone array system of this type, the estimation of a sound signal to be received in an arbitrary position S ($x_{s1}$, $y_{s2}$, $z_{s3}$) is performed as follows. As shown in FIG. 4(*a*), received sound signals in predetermined positions (e.g., ($x_{s1}$, $y_0$, $z_0$), ($x_{s1}$, $y_1$, $z_0$), ($x_{s1}$, $y_2$, $z_0$)) are obtained from at least three rows with respect to one direction (e.g., the direction parallel to the x axis). The obtained three estimated sound signals to be received are regarded as estimated rows for the next stage to obtain a received sound signal in a predetermined position (e.g., ($x_{s1}$, $y_{s2}$, $z_0$)) in the next axis component. This process is repeated so as to obtain sound signals to be received in at least three positions (e.g., the remaining ($x_{s1}$, $y_{s2}$, $z_1$), ($x_{s1}$, $y_{s2}$, $z_2$)) in the next axis direction, as shown in FIG. 4(*b*). Then, a final estimated sound signal to be received (in the arbitrary position S ($x_{s1}$, $y_{s2}$, $z_{s3}$)) is obtained based on these three estimated sound signals to be received.

As described above, in the microphone array system of Embodiment 2, the basic principle for the estimation of a sound signal to be received is applied to the estimation in each direction and row. The relationship between the difference, i.e., gradient between neighborhood points on the time axis of the sound pressure of a sound signal to be received of each microphone and the difference, i.e., gradient between neighborhood points on the spatial axis of the air particle velocity is utilized. In addition, the relationship between the difference, i.e., gradient between neighborhood points on the spatial axis of the sound pressure and the difference, i.e., gradient between neighborhood points on the time axis of the air particle velocity is utilized. Utilizing the above relationships and based on the temporal variation of the sound pressure and the spatial variation of the air particle velocity of the received sound signals in at least three positions aligned along one direction (first direction), sound signals to be received in at least three positions in a direction that crosses the first direction are estimated. Then, a sound signal in the direction that crosses the first direction can be estimated based on the estimated signals in the three positions.

Embodiment 3

Embodiment 3 uses directional microphones as the microphones to be used, and each directional microphone is arranged so that the direction of directionality thereof is directed to each axis direction. This embodiment provides the same effect as when the boundary conditions with respect to one direction are provided from the beginning.

Figure 5:
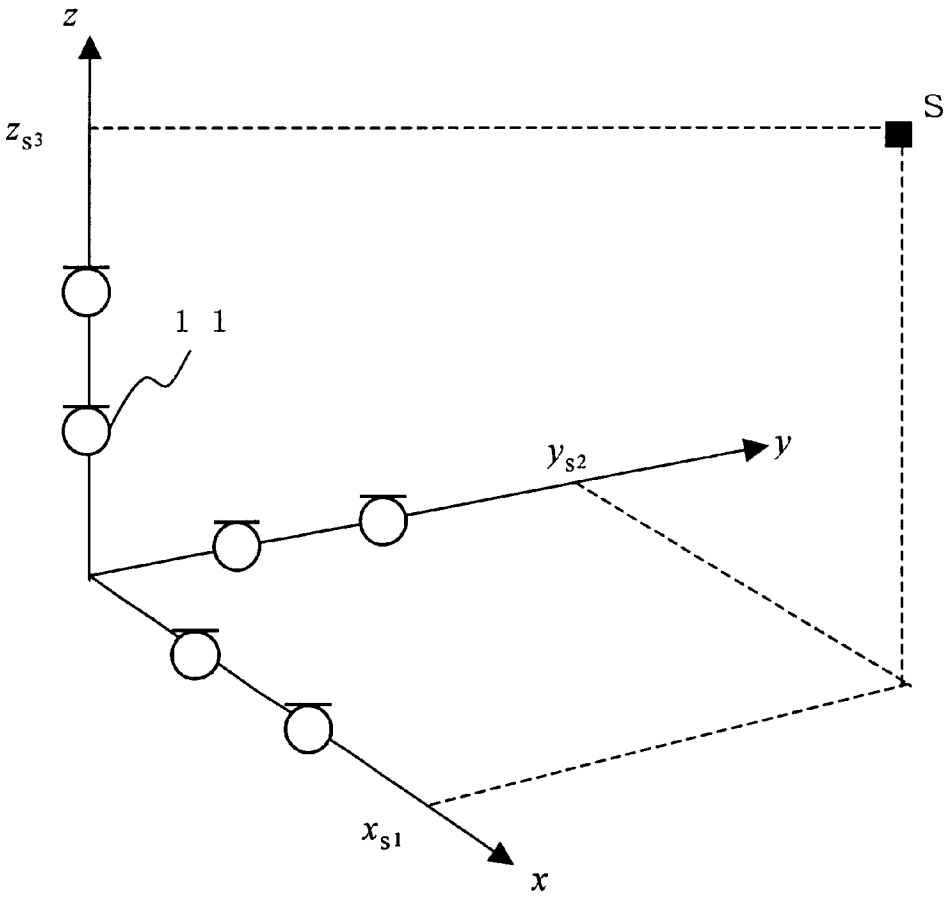
FIG. 5 is a schematic diagram of a basic configuration of a microphone array system of Embodiment 3 of the present invention.

FIG. 5 shows an example of a microphone array system including a plurality of directional microphones, where at least two directional microphones are arranged with directionality onto each spatial axis. The microphone array system shown in FIG. 5 has the smallest configuration of two directional microphones on each axis.

In the microphone array system of this type, the directionality is directed along a corresponding axis. For estimation of a sound signal to be received in an arbitrary position S ($x_{s1}$, $y_{s2}$, $z_{s3}$), a sound signal to be received in each position corresponding to a component on each spatial axis in the arbitrary position S in a defined three-dimensional space is estimated from two received sound signals, and a vector sum of the three-dimensional components is calculated.

Similarly to Embodiment 1, in this embodiment where the components in the spatial axis directions are synthesized to obtain an estimated sound signal to be received, the processing for estimating a sound signal to be received can be performed easily, on the premise that an influence of the variation in the sound pressure and the air particle velocity of a sound signal in one spatial axis direction on the variation in the sound pressure and the air particle velocity of a sound signal in another spatial axis direction can be ignored.

As described above, the microphone array system of Embodiment 3 uses at least two directional microphones in each spatial axis direction, and utilizes the following relationships: the relationship between the difference, i.e., gradient between neighborhood points on the time axis of the sound pressure of a received sound signal of each microphone; and the difference, i.e., gradient between neighborhood points on the spatial axis of the air particle velocity and the relationship between the difference, i.e., gradient between neighborhood points on the spatial axis of the sound pressure and the difference, i.e., gradient between neighborhood points on the time axis of the air particle velocity. Utilizing the above relationships and based on the temporal variation of the sound pressure and the spatial variation of the air particle velocity of the received sound signal of each directional microphone arranged in each spatial axis direction, a sound signal to be received in each axis component in an arbitrary position is estimated. Then, the estimated signals are synthesized three-dimensionally, so that a sound signal in the arbitrary position in the space can be estimated.

Embodiment 4

Figure 6:
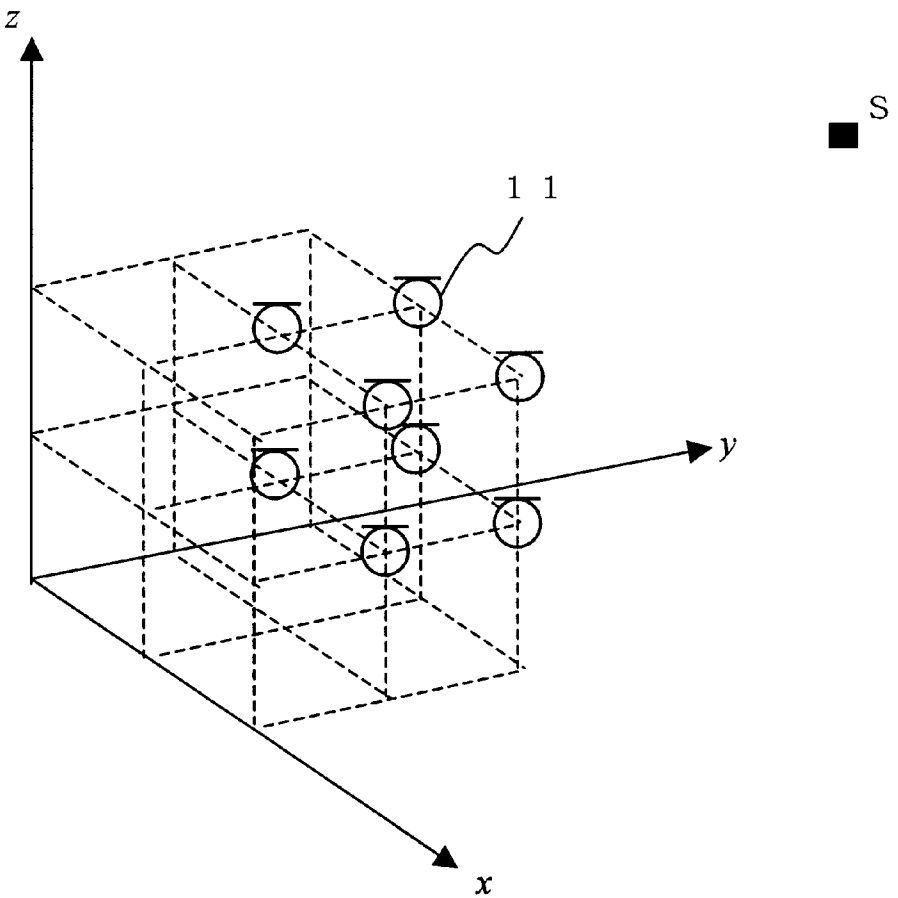
FIG. 6 is a schematic diagram of a basic configuration of a microphone array system of Embodiment 4 of the present invention.

Embodiment 4 uses directional microphones as the microphones to be used. FIG. 6 shows the microphone array system of Embodiment 4, which is an example of the following arrangement. At least two directional microphones are arranged in one direction to form a microphone row. At least two rows of the directional microphones are arranged so that the microphone rows are not crossed each other so as to form a plane. At least two layers of the planes are arranged three-dimensionally so that the planes are not crossed each other. Thus, the microphones are arranged so that the boundary conditions for sound estimation at each plane of the planes constituting the three dimension can be obtained. The microphone array system of Embodiment 4 includes 8 directional microphones, which is the smallest configuration of this arrangement. Similarly to Embodiment 3, this embodiment provides the same effect as when the boundary conditions with respect to one direction to which the directionality is directed are provided from the beginning. The processing for estimating a sound signal to be received with respect to an arbitrary position S in the three-dimensional space is performed in the same manner as in Embodiment 2, except that the sound signal to be received can be estimated from two signals with respect to one direction and row.

Embodiment 5

Embodiment 5 is a microphone array system whose characteristics are adjusted by optimizing the interval distance between arranged microphones. The interval distance between adjacent microphones is within a distance that satisfies the sampling theorem on the spatial axis for the frequency of a sound signal to be received.

The probability of the estimation processing in the basic principle of the sound signal estimation as described above becomes higher, as the interval distance between the microphones becomes narrower. In this case, the maximum $l_{max}$ of the interval distance between adjacent microphones is expressed by Equation 20, in view that it is necessary to satisfy the sampling theorem.

$$l_{max}=(\text{the sound velocity}/(\text{the maximum frequency of the sound signal to be received}\times 2)) \qquad \text{Equation 20}$$

Thus, it is sufficient that the interval distance between adjacent microphones with respect to the maximum frequency of the sound signal that is assumed to be received is in the range that satisfies Equation 20.

Figure 7:
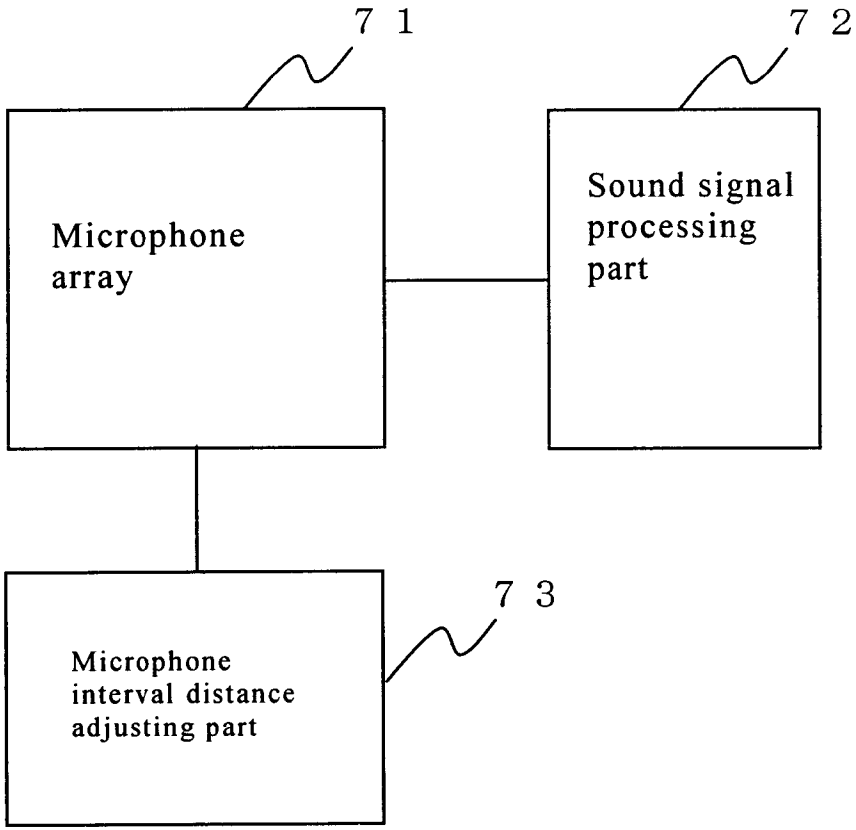
FIG. 7 is a schematic diagram of a basic configuration of a microphone array system of Embodiment 5 of the present invention.

The microphone array system of Embodiment 5 includes a microphone interval distance adjusting part 73 for changing and adjusting the interval distance between arranged microphones, as shown in FIG. 7. The microphone interval distance adjusting part 73 changes and adjusts the interval distance between the microphones by moving the microphones in accordance with the frequency characteristics of a sound output from a sound source, in response to external input instructions or autonomous adjustment. The microphone can be moved, for example by a moving device that may be provided in the support of the microphone.

In the case where the microphone interval distance is made small so that the Equation 20 is satisfied, it is necessary to adjust the coefficients of Equations 5 to 8 shown in the sound signal estimation processing. The coefficients at an interval distance l are obtained by Equation 21.

$$a = \frac{l}{l_{\max}} a_{base} \qquad \text{Equation 21}$$

$$b = \frac{l}{l_{\max}} b_{base}$$

where $l_{max}$ is the maximum value of the microphone interval distance, and $a_{base}$ and $b_{base}$ are the coefficients a and b of Equations 5 to 8.

As described above, the configuration of the microphone array system can be adjusted so that Equation 20 can be satisfied by changing and adjusting the microphone interval distance by moving the microphone itself with external input instructions to the microphone interval distance adjusting part 73 or autonomous adjustment of the microphone interval distance adjusting part 73.

Embodiment 6

Embodiment 6 is a microphone array system that can be adjusted so that in the sound signal estimation processing of the microphone array system of the present invention, the sampling theorem on the spatial axis as shown in Equation 20 is satisfied with respect to the frequency of a sound output from a sound source. Embodiment 6 provides the same effect as Embodiment 5 by interpolation on the spatial axis, instead of the method for physically changing the interval distance between the microphones as show in Embodiment 5.

For simplification, in this embodiment, only the interpolation adjustment in the x axis direction will be described, but the interpolation adjustment in the y axis and z axis directions can be performed in the same manner.

Figure 8:
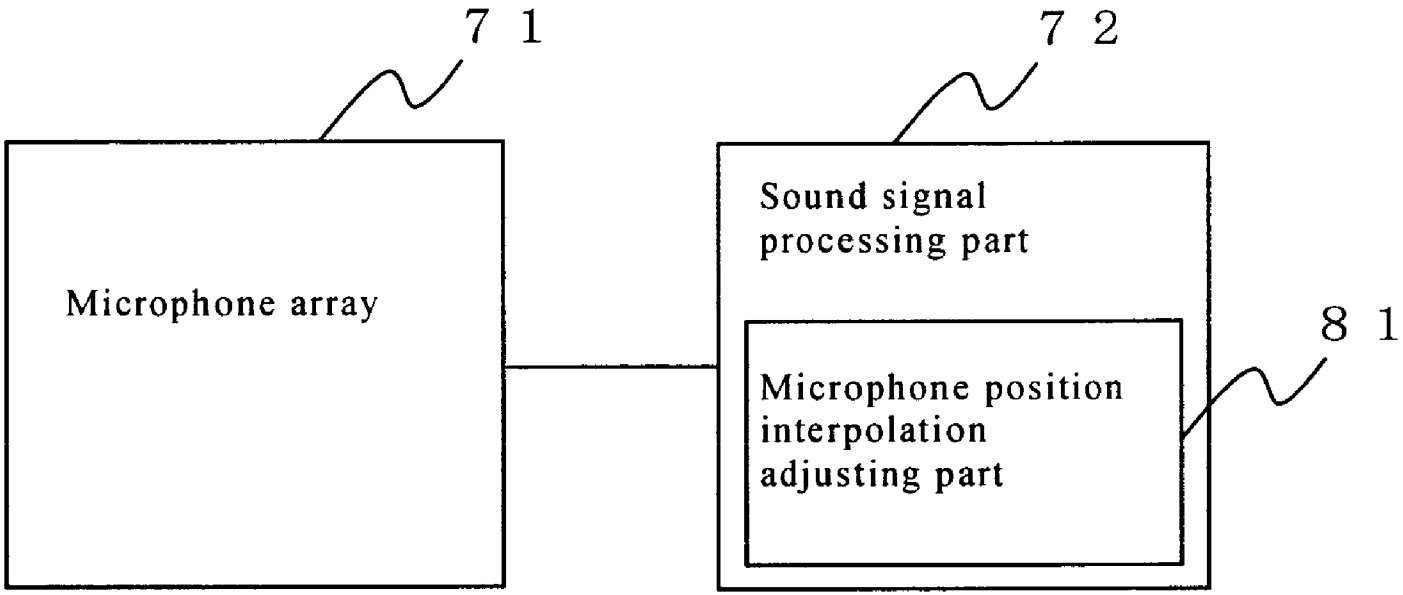
FIG. 8 is a schematic diagram of a basic configuration of a microphone array system of Embodiment 6 of the present invention.

As shown in FIG. 8, the sound signal processing part of the microphone array system includes a microphone position interpolation processing part. The microphone position interpolation processing part 81 changes and adjusts the interval distance between the arranged microphones virtually by performing position-interpolation-processing with respect to a signal received by each microphone.

When the original microphone interval distance is represented by $l_{base}$ and calculation is performed with interpolation, as shown in Equation 22, the same sound signal estimation can be performed as when the interval distance between adjacent microphones is changed to l.

$$p'(x_0, y_1, t_k) = \frac{l}{l_{base}}(p(x_0, y_1, t_k) - p(x_1, y_1, t_k)) + p(x_1, y_1, t_k))$$

$$p'(x_2, y_1, t_k) = \frac{l}{l_{base}}(p(x_2, y_1, t_k) - p(x_1, y_1, t_k)) + p(x_1, y_1, t_k))$$

Equation 22

As described above, the microphone position interpolation processing part 81 performs interpolation processing with respect to the frequency characteristics of a sound output from the sound source, so that the microphone array system of this embodiment can be adjusted to satisfy the sampling theorem on the spatial axis shown in Equation 20.

Embodiment 7

Embodiment 7 aims at improving the probability of the sound signal estimation processing in an arbitrary position by adjusting the sampling frequency in the received sound processing at the microphones and performing oversampling with respect to the frequency characteristics of a sound output from the sound source.

Figure 9:
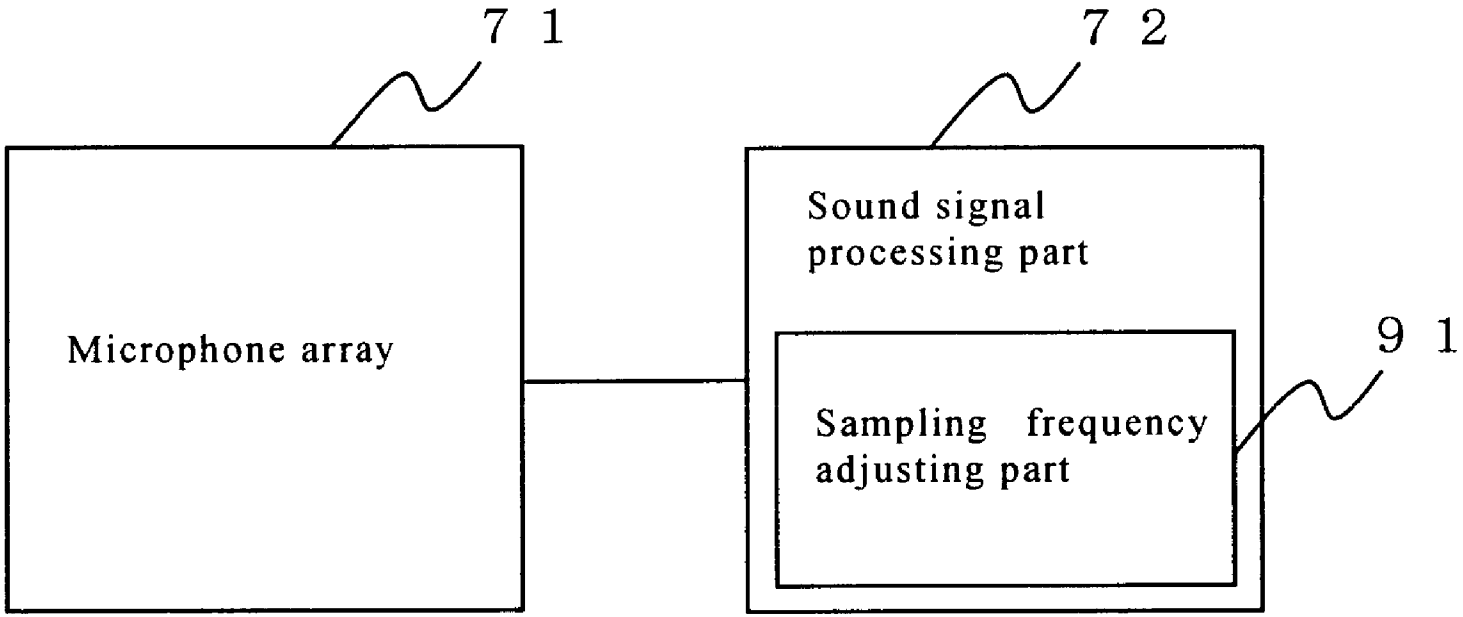
FIG. 9 is a schematic diagram of a basic configuration of a microphone array system of Embodiment 7 of the present invention.

In the microphone array system of Embodiment 7, as shown in FIG. 9, a sound signal processing part includes a sampling frequency adjusting part for adjusting the sampling frequency for the processing of sounds received at the microphones. The sampling frequency adjusting part 91 changes the sampling frequency so that oversampling is achieved.

The probability of the estimation processing in the basic principle of the sound signal estimation as described above becomes higher, as oversampling is performed to greater extent. In this case, in order to satisfy the sampling theorem, the minimum value $F_{smin}$ of the sampling frequency is $F_{smin}$=(the maximum frequency of the sound signal to be received×2). The maximum frequency of the sound signal to be received is determined by the cutoff frequency of an analog low pass filter in front of an AD (analog-digital) converter. Therefore, oversampling can be achieved by raising the sampling frequency of the AD converter while maintaining the cutoff frequency of the low pass filter constant.

The coefficients at an sampling frequency Fs are obtained by Equation 23.

$$a = \frac{Fs}{Fs_{\min}} a_{base}$$

$$b = \frac{Fs}{Fs_{\min}} b_{base}$$

Equation 23 where $a_{base}$ and $b_{base}$ are the coefficients of Equations 5 to 8 at an sampling frequency $F_{smin}$.

As described above, the sampling frequency adjusting part 91 achieves oversampling of the sampling frequency, so that the probability of the sound signal estimation processing in an arbitrary position can be improved

Embodiment 8

Embodiment 8 aims at improving the probability of the sound signal estimation processing in an arbitrary position by performing band division and frequency shift of each signal to a lower band in the processing of the sound signals received by the microphones. Thus, the same effect as obtained by sampling frequency adjustment can be obtained.

Figure 10:
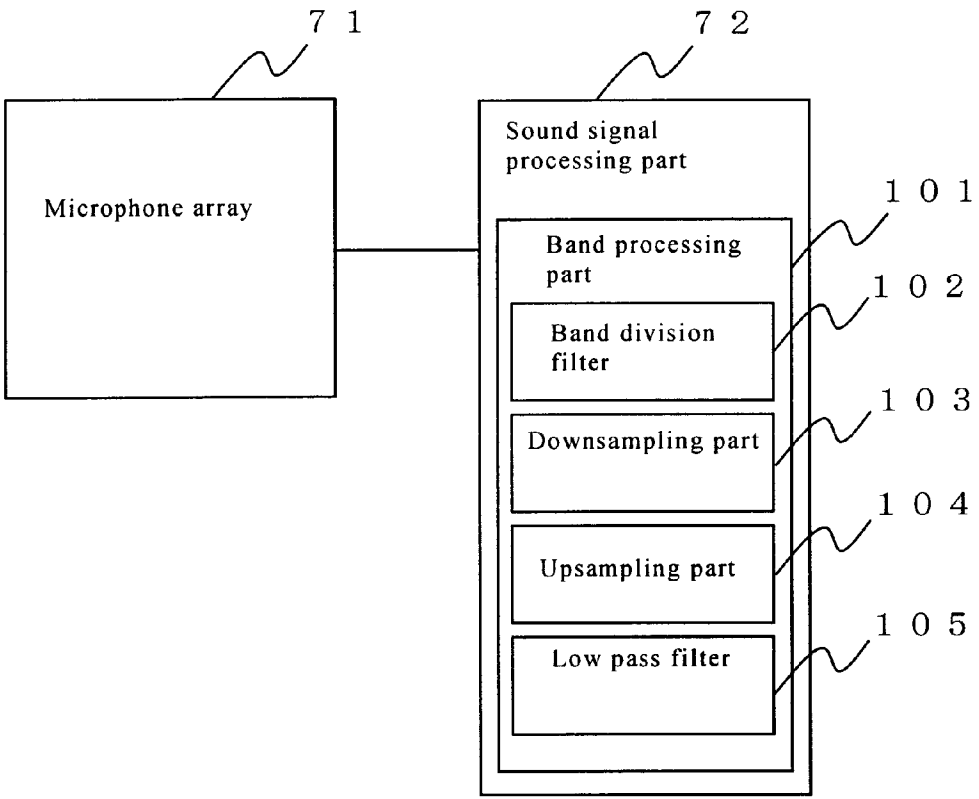
FIG. 10 is a schematic diagram of a basic configuration of a microphone array system of Embodiment 8 of the present invention.

FIG. 10 shows the microphone array system of Embodiment 8. As shown in FIG. 10, a sound signal processing part 72 includes a band processing part 101 for performing band division processing and downsampling for a received sound signal at a microphone array 71. A signal that has been subjected to the band division processing by the band processing part 101 is subjected to frequency-shift to a low band in the original band, so that relative sampling frequency adjustment is performed. Thus, the probability of the sound signal estimation processing in an arbitrary position can be improved.

A tree structure filter or a polyphase filter bank can be used for a band division filter 102 of the band processing part 101. In this embodiment, the band division filter 102 divides into four bands. Next, downsampling to decrease the sampling rate to 1/4 times is performed by a downsampling part 103. Next, upsampling to enhance the sampling rate to 4 times is performed by adding 0 sequence by an upsampling part 104. Finally, the signal passes through a low pass filter 104 having a cutoff frequency of $F_c$=$F_s$/8.

The frequency shift processing of the band processing part 101 provides the same effect as obtained by the sampling frequency adjustment, so that the probability of the sound signal estimation processing in an arbitrary position can be improved.

Embodiment 9

In Embodiment 9, only an estimated sound in a specific direction is enhanced by setting parameters in the sound signal processing part of the microphone array system so that a desired sound is enhanced. Moreover, an estimated sound in a specific direction is attenuated so that noise is suppressed.

Figure 11:
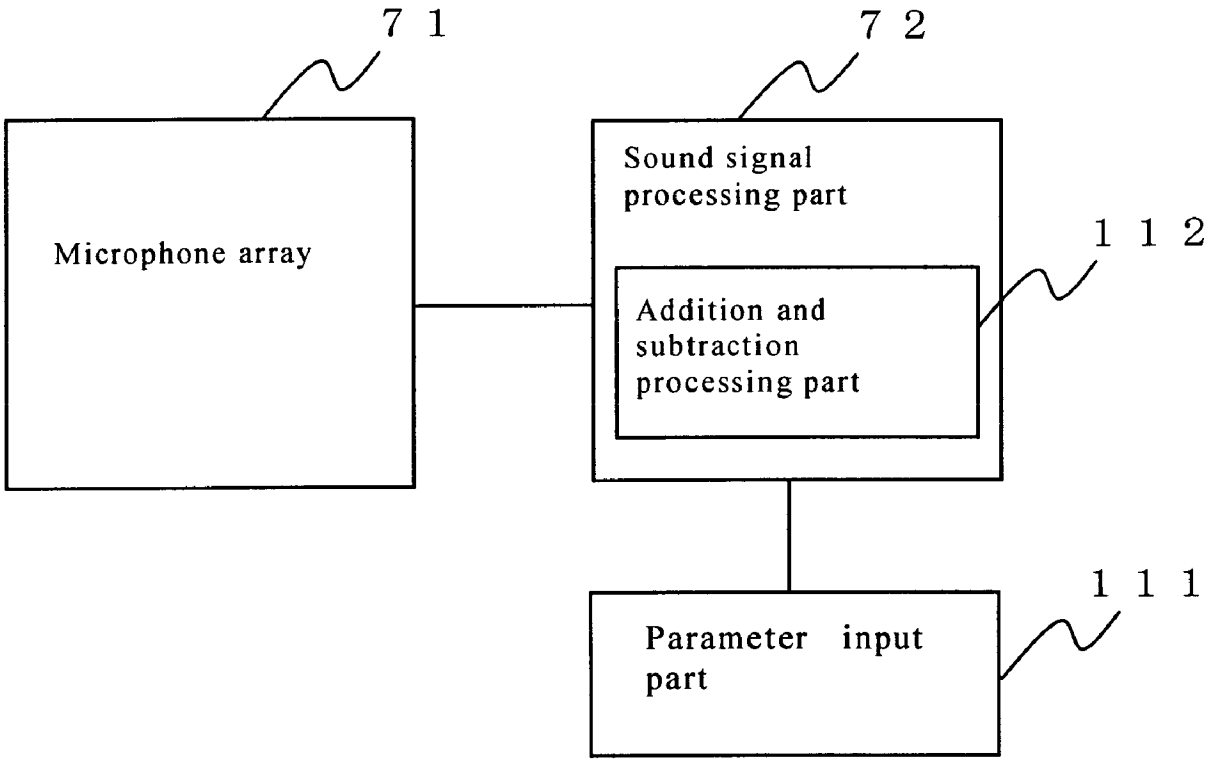
FIG. 11 is a schematic diagram of a basic configuration of a microphone array system of Embodiment 9 of the present invention.

FIG. 11 shows an example of a configuration of the microphone array system of Embodiment 9.

The microphone array system includes a parameter input part 111 for receiving an input of a parameter for adjusting signal processing contents.

A sound signal enhancement direction parameter for designating a specific direction in which the sound signal estimation is enhanced is supplied to the parameter input part 111. In this case, as the sound signal estimation processing of the sound signal processing part 72, an estimation result in a specific direction shown in the basic principle is subjected to addition processing by an addition and subtraction processing part 112 so that the sound signal from the sound source in the specific direction is enhanced.

Furthermore, a sound signal attenuation direction parameter for designating a 25 specific direction in which the sound signal estimation is reduced is supplied to the parameter input part 111. In this case, as the sound signal estimation processing of the sound signal processing part 72, subtraction processing for removing a sound signal from a sound source in a specific direction is performed by the addition and subtraction processing part 112 so that the noise signal from the sound source in the specific direction is suppressed.

Embodiment 10

Embodiment 10 detects whether or not sound sources are present in a plurality of arbitrary positions in a sound field.

The detection of a sound source is performed by utilizing cross-correlation function between estimated sound signals based on the estimated sound signals, or checking the power of a sound signal obtained from the synchronous addition of estimated signals with respect to a direction so as to determine whether or not the sound source is present.

Figure 12:
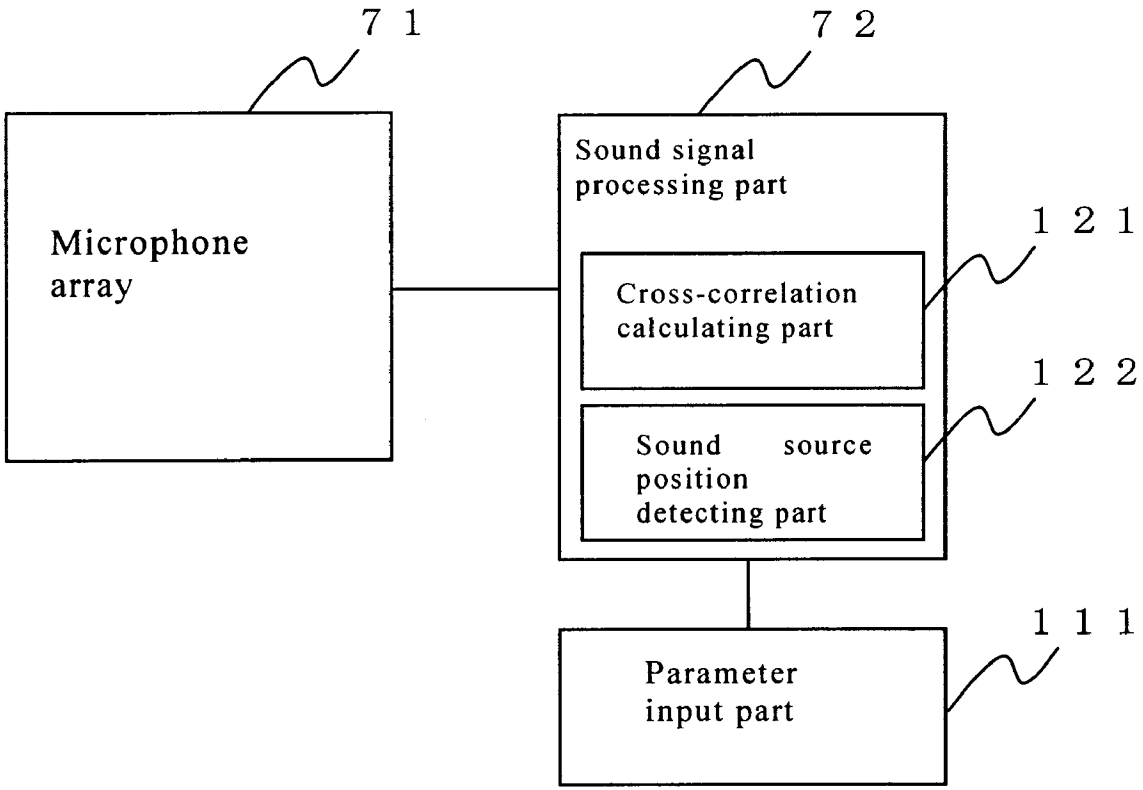
FIG. 12 is a schematic diagram of a basic configuration of a microphone array system of Embodiment 10 of the present invention.

In the case where the cross-correlation function between the estimated sound signals is utilized, as shown in FIG. 12, for the sound signal estimation of the sound signal processing part 72, the cross-correlation function between estimated sound signals is calculated, based on the sound signal estimated with respect to each direction by a cross-correlation calculating part 121. A position where the cross-correlation calculated by a sound source position detecting part 122 is the largest is detected so that the position of the sound source can be estimated.

Figure 13:
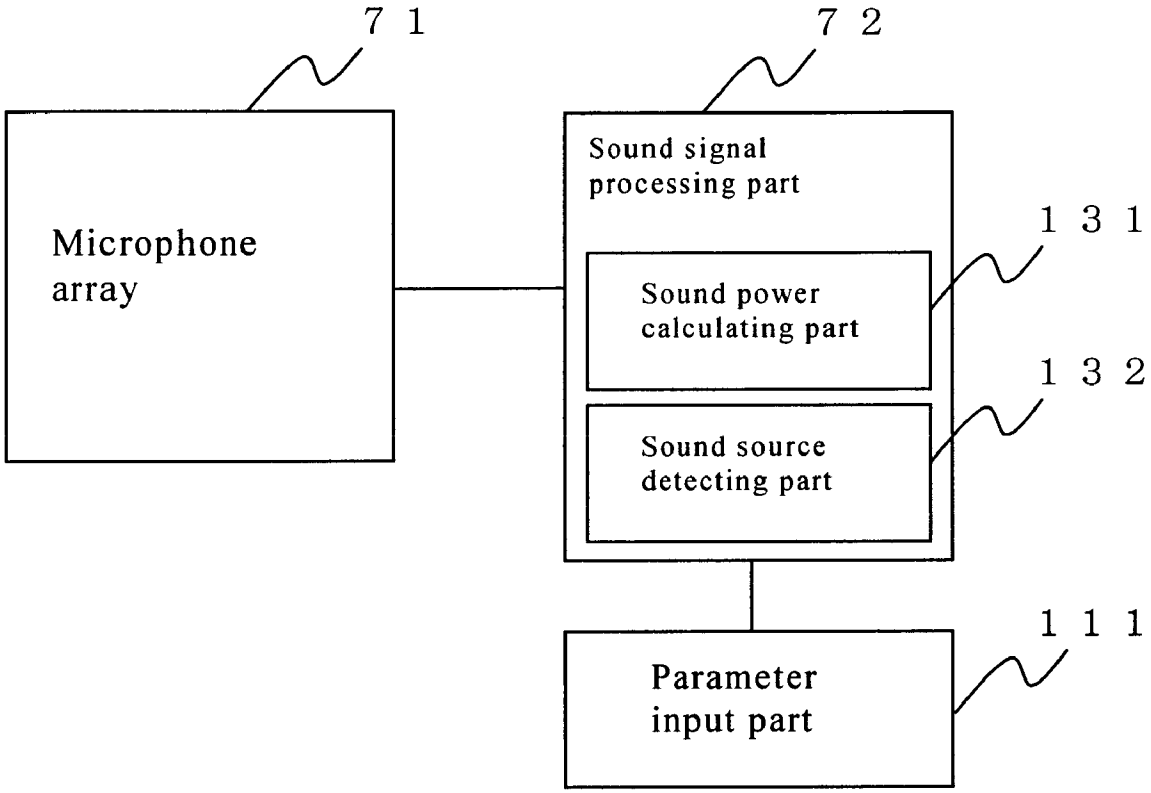
FIG. 13 is a schematic diagram of a basic configuration of a microphone array system of Embodiment 10 of the present invention.
Figure 14:
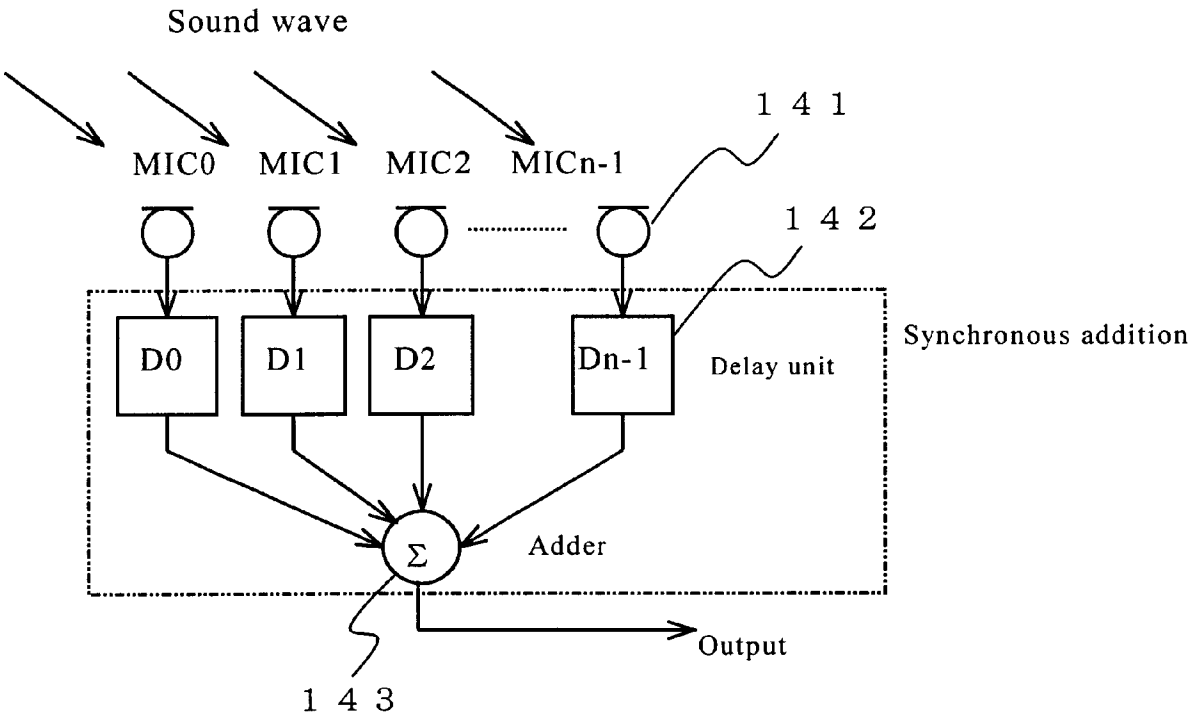
PRIOR ART Fig. 14
FIG. 14 is a schematic diagram showing desired-signal-enhancement using a conventional microphone array system.

Furthermore, in a microphone array system that detects the existence of the sound source using the sound power of a synchronous added sound signal, as shown in FIG. 13, the sound signal processing part 72 of the microphone array system includes a sound power detecting part 131. The sound power detecting part 131 checks the power of the sound signal obtained from the synchronous addition of estimated signals in an assumed direction. Then, a sound source detecting part 132 determines that there is a sound source in the direction when the sound power is above a certain value.

In this embodiment, as a result of the synchronous addition in the x axis direction, the sound power pow of $p_x(t_k)$ that is a result of synchronous addition is calculated with Equation 24. It is determined that there is a sound source in the x axis direction when the result is equal to or more than a threshold value.

$$pow = \sum_k p_x(t_k)^2 \qquad \text{Equation 24}$$

For a value of the sound power, for example, when the sound source to be detected is a person, it is appropriate to use a sound power of a voice that a person speaks. When the sound source to be detected is a car, it is appropriate to use a sound power of a sound of a car engine.

The embodiments described above are examples of the present invention, and therefore, although the number of microphones constituting the microphone array system, the arrangement and the interval distance between the microphones in the embodiments are specific in the embodiment, they are only illustrative and not limiting the present invention.

The microphone array system of the present invention can estimate received sound signals in a larger number of arbitrary positions with a small number of microphones, thus contributing to space-saving.

The microphone array system of the present invention estimates a sound signal in an arbitrary position in a space in the following manner. The relationship between the gradient on the time axis of the sound pressure and the gradient on the spatial axis of the air particle velocity of a received sound signal of each microphone is utilized. In addition, the relationship between the gradient on the spatial axis of the sound pressure and the gradient on the time axis of the air particle velocity is utilized. Utilizing the above relationships and based on the temporal variation of the sound pressure and the spatial variation of the air particle velocity of the received sound signal of each microphone arranged in each spatial axis direction, a sound signal to be received in each axis component in an arbitrary position is estimated. Then, the estimated signals are synthesized three-dimensionally, so that a sound signal in the arbitrary position in the space can be estimated.

Furthermore, according to the microphone array system of the present invention, the boundary conditions for sound estimation at each plane of the planes constituting the three dimension can be obtained from each microphone. The relationship between the gradient on the time axis of the sound pressure and the gradient on the spatial axis of the air particle velocity of a received sound signal of each microphone is utilized. In addition, the relationship between the gradient on the spatial axis of the sound pressure and the gradient on the time axis of the air particle velocity is utilized. Utilizing the above relationships and based on the temporal variation of the sound pressure and the spatial variation of the air particle velocity of the received sound signal of each microphone arranged in each spatial axis direction, a sound signal to be received in each axis component in an arbitrary position is estimated. Then, the estimated signals are synthesized three-dimensionally, so that a sound signal in the arbitrary position in the space can be estimated.

Furthermore, according to the microphone array system of the present invention, high quality signal processing can be performed in a necessary frequency range by satisfying the sampling theorem. In order to satisfy the sampling theorem, the adjustment of the interval distance between microphones, the position interpolation processing of a received sound signal at each microphone for the virtual adjustment of the interval distance between the microphones, the adjustment of sampling frequency, and the shift of the frequency of a signal received at the microphone can be performed.

Furthermore, according to the microphone array system of the present invention, addition processing and subtraction processing are performed by setting parameters to be supplied to a parameter input part, so that a desired sound can be enhanced, and noise can be suppressed.

Furthermore, according to the microphone array system of the present invention, the position of a sound source can be estimated by utilizing the cross-correlation function between estimated sound signals or detecting the sound power.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A microphone array system comprising a plurality of microphones and a sound signal processing part, wherein at least three microphones are arranged on each spatial axis, and the sound signal processing part estimates a sound signal in an arbitrary position in a space by estimating a sound signal to be received at each axis component in the arbitrary position, utilizing a relationship between a difference, which is a gradient, between neighborhood points on a time axis of a sound pressure of a received sound signal of each microphone and a difference, which is a gradient, between neighborhood points on a spatial axis of an air particle velocity, and a relationship between a difference, which is a gradient, between neighborhood points on a spatial axis of the sound pressure and a difference, which is a gradient, between neighborhood points on a time axis of the air particle velocity, and based on a temporal variation of the sound pressure and a spatial variation of the air particle velocity of the received sound signal of each microphone arranged in each spatial axis direction; and synthesizing the estimated signals three-dimensionally.

2. The microphone array system according to claim 1, wherein in the estimation of a sound signal in an arbitrary position in a space, the sound signal estimation processing for each spatial axis direction is performed on a premise that an influence of a variation in the sound pressure and the air particle velocity of a sound signal in one spatial axis direction on a variation in the sound pressure and the air particle velocity of a sound signal in another spatial axis direction can be ignored.

3. A microphone array system comprising a plurality of microphones and a sound signal processing part, wherein the microphones are arranged in such a manner that at least three microphones are arranged in a first direction to form a microphone row, at least three rows of the microphones are arranged so that the microphone rows are not crossed each other so as to form a plane, and at least three layers of the planes are arranged three-dimensionally so that the planes are not crossed each other, so that boundary conditions for sound estimation at each plane of the planes constituting a three dimension can be obtained, and the sound signal processing part estimates a sound in each direction of a three-dimensional space by estimating sound signals in at least three positions along a direction that crosses the first direction, utilizing a relationship between a difference, which is a gradient, between neighborhood points on a time axis of a sound pressure of a received sound signal of each microphone and a difference, which is a gradient, between neighborhood points on a spatial axis of an air particle velocity, and a relationship between a difference, which is a gradient, between neighborhood points on a spatial axis of the sound pressure and a difference, which is a gradient, between neighborhood points on a time axis of the air particle velocity, and based on a temporal variation of the sound pressure and a spatial variation of the air particle velocity of received sound signals in at least three positions aligned along the first direction; and further estimating a sound signal in the direction that crosses the first direction based on the estimated signals in the three positions.

4. The microphone array system according to claim 3, wherein the relationship between a gradient on a time axis of a sound pressure and a gradient on a spatial axis of an air particle velocity of a received sound signal is expressed by Equation 25:

$$(v_x(x_{i+1},y_j,z_g,t_k)-v_x(x_i,y_j,z_g,t_k))+(v_y(x_i,y_{j+1},z_g,t_k)-v_y(x_i,y_j,z_g,t_k))+(v_z(x_i,y_j,z_{g+1},t_k)-v_z(x_i,y_j,z_g,t_k))=b(p(x_{i+1},y_{j+1},z_{g+1},t_{k+1})-p(x_{i+1},y_{j+1},z_{g+1},t_k)) \quad \text{Equation 25}$$

where x, y, and z are spatial axis components, t is a time component, v is an air particle velocity, p is a sound pressure, and b is a coefficient.

5. The microphone array system according to claim 3, wherein the sound signal processing part comprises a parameter input part for receiving an input of parameter that adjusts a signal processing content.

6. The microphone array system according to claim 3, wherein an interval distance between adjacent microphones of the arranged microphones is within a distance that satisfies a sampling theorem on a spatial axis for a frequency of a sound signal to be received.

7. The microphone array system according to claim 3, comprising a microphone interval distance adjusting part for changing and adjusting an interval distance between the arranged microphones.

8. The microphone array system according to claim 3, wherein the sound signal processing part comprises a microphone position interpolation processing part for changing and adjusting an interval distance between the arranged microphones virtually by performing position-interpolation-processing with respect to a signal received by each of the microphones.

9. The microphone array system according to claim 3, wherein the sound signal processing part comprises a sampling frequency adjusting part for adjusting a sampling frequency for the processing of sounds to be received at the microphones.

10. The microphone array system according to claim 3, wherein the sound signal processing part comprises a band processing part for performing band division processing and frequency shift for band synthesis for a received sound signal at the microphones.

11. The microphone array system according to claim 3, wherein a sound signal enhancement direction parameter for designating a specific direction in which sound signal is enhanced is supplied to the parameter input part, thereby enhancing a sound signal from a sound source in the specific direction.

12. The microphone array system according to claim 3, wherein a sound signal attenuation direction parameter for designating a specific direction in which sound signal is reduced is supplied to the parameter input part, thereby removing a sound signal from a sound source in the specific direction.

13. The microphone array system according to claim 3, which estimates a position of a sound source by detecting a position having a largest cross-correlation, based on estimated sound signals in a plurality of arbitrary positions in a sound field and utilizing a cross-correlation function between the estimated sound signals.

14. The microphone array system according to claim 3, wherein the sound signal processing part comprises a sound power detecting part, and checks a power of a synchronous added sound signal with respect to a direction with the sound power detecting part, so as to detect whether or not there is a sound source in the direction.

15. The microphone array system according to claim 3, wherein the microphones are mutually coupled and supported on a predetermined spatial axis.

16. A microphone array system comprising a plurality of directional microphones and a sound signal processing part, wherein at least two directional microphones are arranged with directivity on each spatial axis, and the sound signal processing part estimates a sound signal in an arbitrary position in a space by estimating a sound signal to be received at each axis component in the arbitrary position utilizing a relationship between a difference, which is a gradient, between neighborhood points on a time axis of a sound pressure of a received sound signal of each microphone and a difference, which is a gradient, between neighborhood points on a spatial axis of an air particle velocity, and a relationship between a difference, which is a gradient, between neighborhood points on a spatial axis of the sound pressure and a difference, which is a gradient, between neighborhood points on a time axis of the air particle velocity, and based on a temporal variation of the sound pressure and a spatial variation of the air particle velocity of a received sound signal of each of the directional microphones arranged in each spatial axis direction; and synthesizing the estimated signals three-dimensionally.

17. A microphone array system comprising a plurality of directional microphones and a sound signal processing part, wherein the directional microphones are arranged in such a manner that at least two directional microphones are arranged with directivity to a first direction to form a microphone row, at least two rows of the directional microphones are arranged so that the microphone rows are not crossed each other so as to form a plane, and at least two layers of the planes are arranged three-dimensionally so that the planes are not crossed each other, so that boundary conditions for sound estimation at each plane of the planes constituting a three dimension can be obtained, and the sound signal processing part estimates a sound in each direction of a three-dimensional space by estimating sound signals in at least two positions along a direction that crosses the first direction, utilizing a relationship between a difference, which is a gradient, between neighborhood points on a time axis of a sound pressure of a received sound signal of each microphone and a difference, which is a gradient, between neighborhood points on a spatial axis of an air particle velocity, and a relationship between a difference, which is a gradient, between neighborhood points on a spatial axis of the sound pressure and a difference, which is a gradient, between neighborhood points on a time axis of the air particle velocity, and based on a temporal variation of the sound pressure and a spatial variation of the air particle velocity of received sound signals in at least two positions aligned along the first direction; and further estimating a sound signal in the direction that crosses the first direction based on the estimated signals in the two positions.

18. The microphone array system according to claim 17, wherein the relationship between a gradient on a time axis of a sound pressure and a gradient on a spatial axis of an air particle velocity of a received sound signal is expressed by Equation 26:

$$(v_x(x_{i+1},y_j,z_g,t_k)-v_x(x_i,y_j,z_g,t_k))+(v_y(x_i,y_{j+1},z_g,t_k)-v_y(x_i,y_j,z_g,t_k))+(v_z(x_i,y_j,z_{g+1},t_k)-v_z(x_i,y_j,z_g,t_k))=b(p(x_{i+1},y_{j+1},z_{g+1},t_{k+1})-p(x_{i+1},y_{j+1},z_{g+1},t_k)) \quad \text{Equation 26}$$

where x, y, and z are spatial axis components, t is a time component, v is an air particle velocity, p is a sound pressure, and b is a coefficient.

19. The microphone array system according to claim 17, wherein the sound signal processing part comprises a parameter input part for receiving an input of parameter that adjusts a signal processing content.

20. The microphone array system according to claim 17, wherein an interval distance between adjacent microphones of the arranged microphones is within a distance that satisfies a sampling theorem on a spatial axis for a frequency of a sound signal to be received.

21. The microphone array system according to claim 17, comprising a microphone interval distance adjusting part for changing and adjusting an interval distance between the arranged microphones.

22. The microphone array system according to claim 17, wherein the sound signal processing part comprises a microphone position interpolation processing part for changing and adjusting an interval distance between the arranged microphones virtually by performing position-interpolation-processing with respect to a signal received by each of the microphones.

23. The microphone array system according to claim 17, wherein the sound signal processing part comprises a sampling frequency adjusting part for adjusting a sampling frequency for the processing of sounds to be received at the microphones.

24. The microphone array system according to claim 17, wherein the sound signal processing part comprises a band processing part for performing band division processing and frequency shift for band synthesis for a received sound signal at the microphones.

25. The microphone array system according to claim 17, wherein a sound signal enhancement direction parameter for designating a specific direction in which sound signal is enhanced is supplied to the parameter input part, thereby enhancing a sound signal from a sound source in the specific direction.

26. The microphone array system according to claim 17, wherein a sound signal attenuation direction parameter for designating a specific direction in which sound signal is reduced is supplied to the parameter input part, thereby removing a sound signal from a sound source in the specific direction.

27. The microphone array system according to claim 17, which estimates a position of a sound source by detecting a position having a largest cross-correlation, based on estimated sound signals in a plurality of arbitrary positions in a sound field and utilizing a cross-correlation function between the estimated sound signals.

28. The microphone array system according to claim 17, wherein the sound signal processing part comprises a sound power detecting part, and checks a power of a synchronous added sound signal with respect to a direction with the sound power detecting part, so as to detect whether or not there is a sound source in the direction.

29. A microphone array system comprising a plurality of microphones and a sound signal processing part, wherein a plurality of microphones are arranged in three mutually orthogonal axis directions in a predetermined space, in which at least three of said microphones are arranged in each of said orthogonal axis directions, and the sound signal processing part connected to the microphones estimates a sound signal in an arbitrary position in a space other than the space where the microphones are arranged based on a relationship between positions where the microphones are arranged and received sound signals.

30. The microphone array system according to claim 17, wherein the microphones are mutually coupled and supported on a predetermined spatial axis.

* * * * *